US010028562B2

(12) United States Patent
Matthew

(10) Patent No.: US 10,028,562 B2
(45) Date of Patent: Jul. 24, 2018

(54) CLOTHING STORAGE SYSTEM

(71) Applicant: Reuel Matthew, White Plains, NY (US)

(72) Inventor: Reuel Matthew, White Plains, NY (US)

( * ) Notice: Subject to any disclaimer, the term of this patent is extended or adjusted under 35 U.S.C. 154(b) by 227 days.

(21) Appl. No.: 14/980,913

(22) Filed: Dec. 28, 2015

(65) Prior Publication Data

US 2017/0181515 A1 Jun. 29, 2017

(51) Int. Cl.

*A45C 13/03* (2006.01)
*A45C 3/00* (2006.01)
*A45C 13/02* (2006.01)

(52) U.S. Cl.

CPC ..... *A45C 13/03* (2013.01); *A45C 3/004* (2013.01); *A45C 2013/026* (2013.01); *A45C 2013/028* (2013.01)

(58) Field of Classification Search

CPC ... A45C 13/03; A45C 3/004; A45C 2013/026; A45C 2013/028

See application file for complete search history.

(56) References Cited

U.S. PATENT DOCUMENTS 485,612 A * 11/1892 Cozens ..... A45C 13/03 190/13 R
2,626,689 A * 1/1953 Davis ..... A45C 3/004 190/113
2,637,424 A * 5/1953 Duskin ..... A47G 25/54 190/112
3,139,133 A * 6/1964 Spector ..... A45C 7/0095 190/111
3,737,013 A * 6/1973 Powell ..... A45C 13/26 206/287.1
4,170,282 A 10/1979 Schwartzstein
4,206,835 A 6/1980 Shapiro
D300,689 S 4/1989 King et al.
4,854,431 A * 8/1989 Pulichino, Jr. ..... A45C 3/00 190/108
4,854,432 A * 8/1989 Carpenter ..... A45C 13/02 190/110
4,998,603 A 3/1991 Nordstrom
RE33,794 E 1/1992 King et al.
5,431,263 A * 7/1995 Nordstrom ..... A45C 5/14 190/18 A
5,954,196 A * 9/1999 Lin ..... A47G 25/54 206/286
6,334,519 B1 * 1/2002 Tong ..... A45C 3/00 190/107
7,415,066 B2 8/2008 Feher
8,251,192 B1 8/2012 Milani
8,459,422 B1 6/2013 Efrom
(Continued)

*Primary Examiner* — Tri Mai

(57) ABSTRACT

A clothing storage system includes a suitcase that includes a first half hingedly coupled to a second half. A bag is provided and the bag may contain an article of clothing. The bag may be fluidly coupled to a vacuum thereby facilitating air to be removed from the bag. The bag is removably coupled to the suitcase such that the bag is contained within the suitcase. A pair of shafts is provided and each of the shafts removably engages the bag. The shafts are spaced apart from each other such that the shafts divide the bag into a plurality of quadrants. The bag may be folded along each of the quadrants such that the bag fits within the suitcase.

6 Claims, 5 Drawing Sheets

(56) References Cited

U.S. PATENT DOCUMENTS

| | | | | |
|---|---|---|---|---|
| 2006/0037824 | A1* | 2/2006 | Park | A45C 13/03<br>190/110 |
| 2009/0052808 | A1* | 2/2009 | Pham | B65D 31/14<br>383/23 |
| 2014/0060989 | A1 | 3/2014 | Johnson | |

* cited by examiner

CLOTHING STORAGE SYSTEM

BACKGROUND OF THE DISCLOSURE

Field of the Disclosure

The disclosure relates to storage devices and more particularly pertains to a new storage device for storing articles of clothing while inhibiting the articles of clothing from becoming wrinkled.

SUMMARY OF THE DISCLOSURE

An embodiment of the disclosure meets the needs presented above by generally comprising a suitcase that includes a first half hingedly coupled to a second half. A bag is provided and the bag may contain an article of clothing. The bag may be fluidly coupled to a vacuum thereby facilitating air to be removed from the bag. The bag is removably coupled to the suitcase such that the bag is contained within the suitcase. A pair of shafts is provided and each of the shafts removably engages the bag. The shafts are spaced apart from each other such that the shafts divide the bag into a plurality of quadrants. The bag may be folded along each of the quadrants such that the bag fits within the suitcase.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
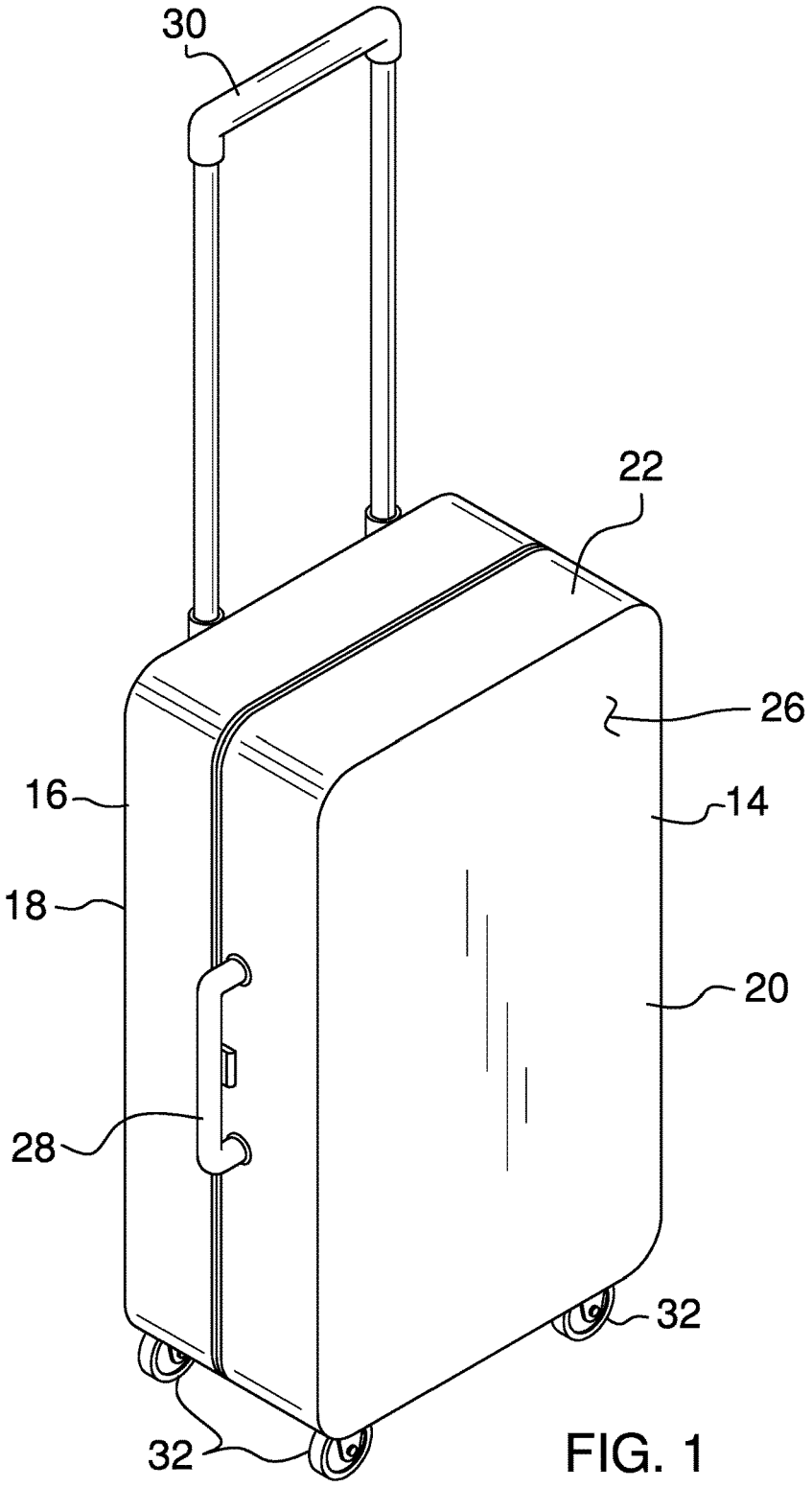
FIG. 1 is a front perspective view of a clothing storage system according to an embodiment of the disclosure.
Figure 2:
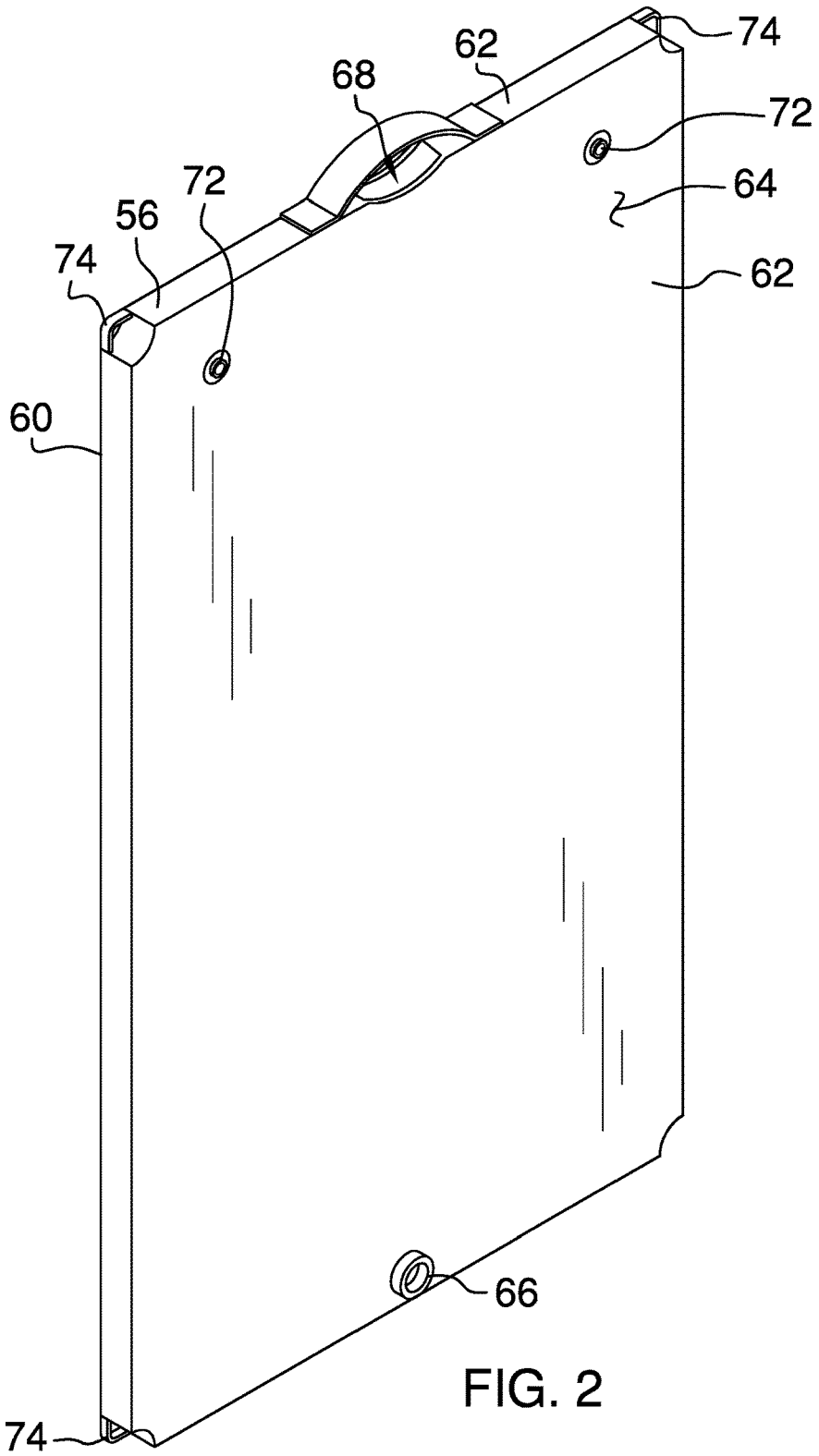
FIG. 2 is a perspective view of a bag of an embodiment of the disclosure.
Figure 3:
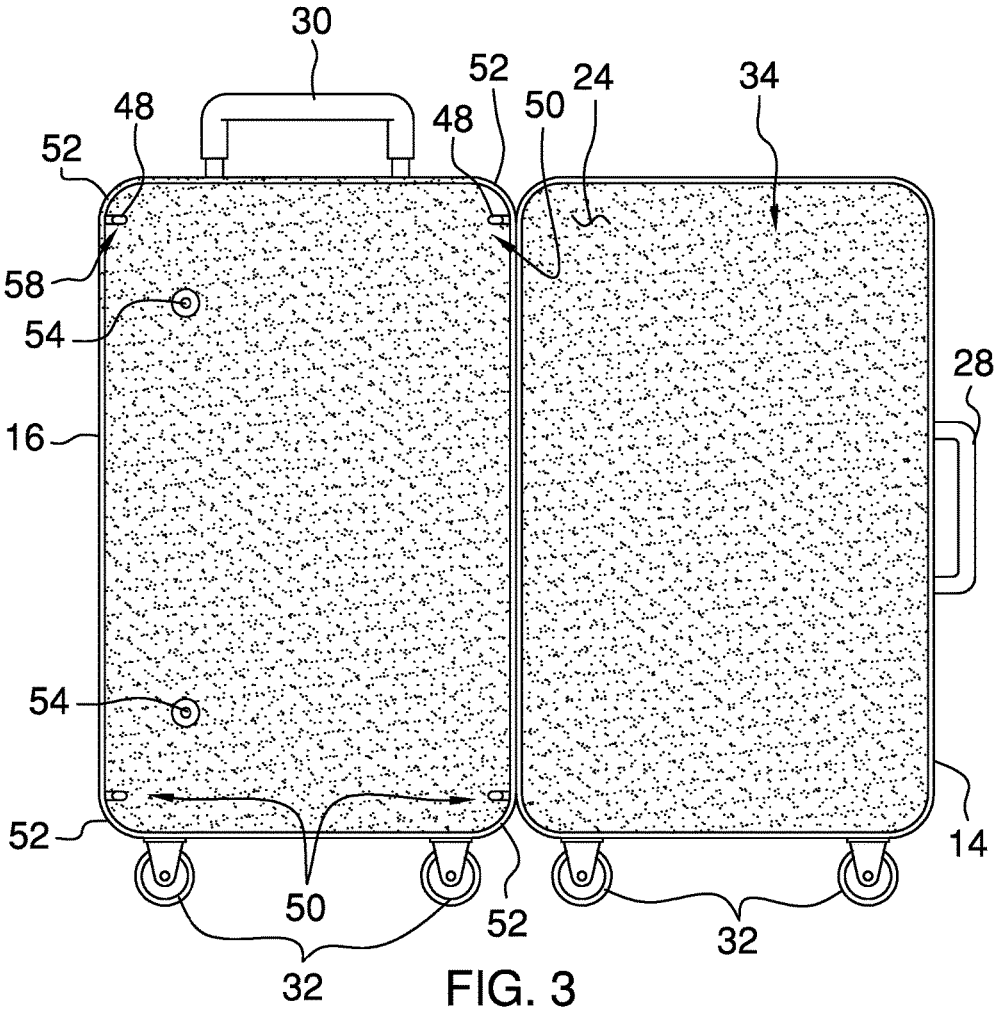
FIG. 3 is a front view of a suitcase of embodiment of the disclosure in an open position.
Figure 4:
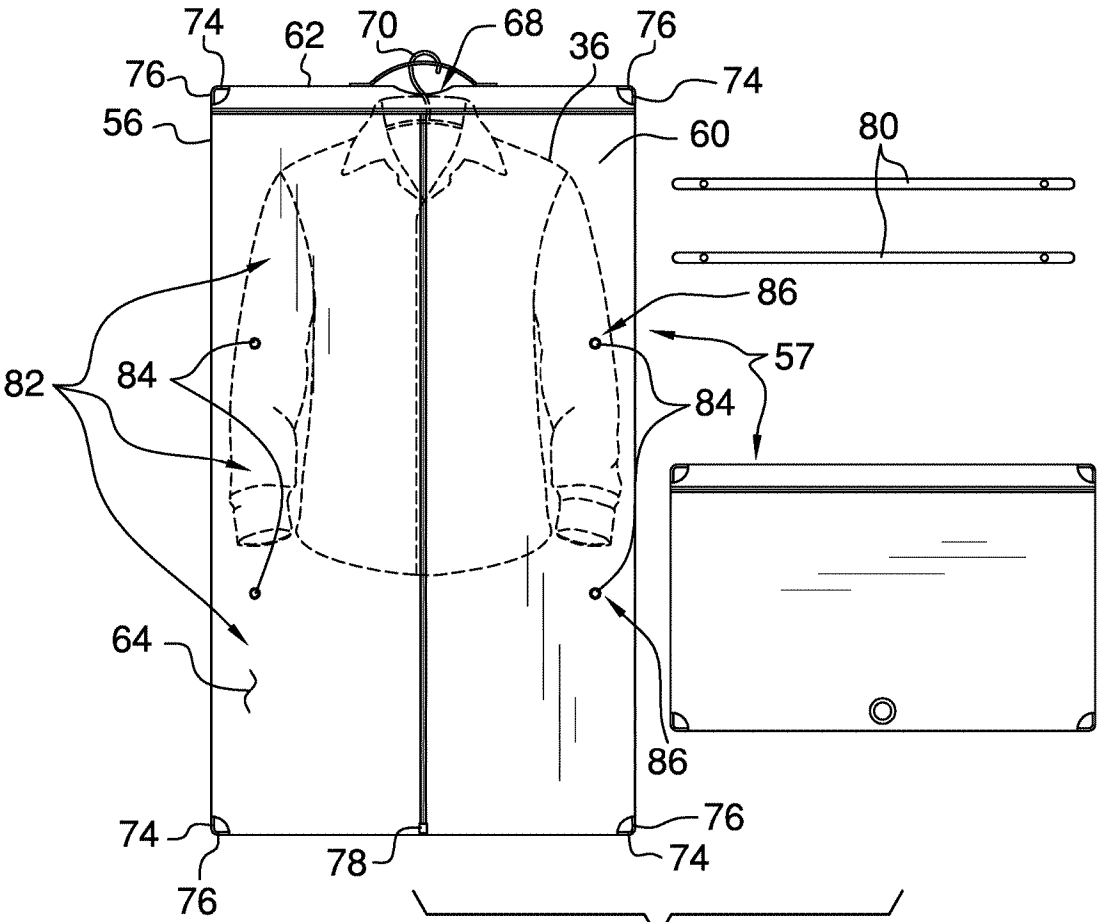
FIG. 4 is a rear view of a bag of an embodiment of the disclosure.
Figure 5:
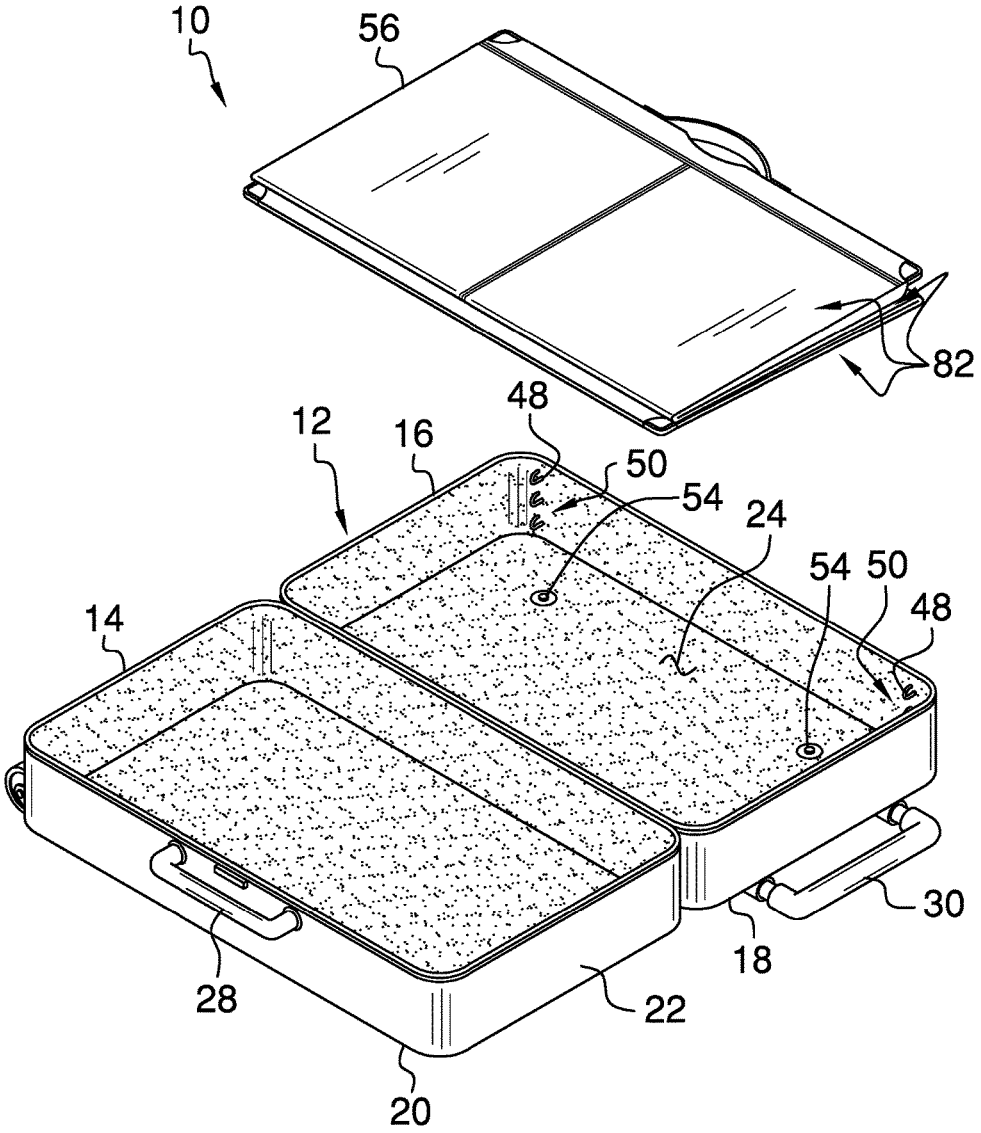
FIG. 5 is a perspective in-use view of an embodiment of the disclosure.

With reference now to the drawings, and in particular to FIGS. 1 through 5 thereof, a new storage device embodying the principles and concepts of an embodiment of the disclosure and generally designated by the reference numeral 10 will be described.

As best illustrated in FIGS. 1 through 5, the clothing storage system 10 generally comprises a suitcase 12 that has a first half 14 being hingedly coupled to a second half 16 such that the suitcase 12 is positionable between an open position and a closed position. The suitcase 12 has a back wall 18, a front wall 20 and a peripheral wall 22 extending between the back wall 18 and the front wall 20. The suitcase 12 has and an inner surface 24 and an outer surface 26. The suitcase 12 may be comprised of a rigid material and the inner surface 24 may be comprised of a compressible material such as cotton or the like.

A grip 28 is coupled to the outer surface 26 corresponding to the first half 14. The grip 28 may be positioned on the peripheral wall 22 corresponding to the first half 14. A handle 30 is movably coupled to the suitcase 12 and the handle 30 may be positioned on the back wall 18. The handle 30 has a telescopically adjustable length. A plurality of wheels 32 is rotatably coupled to the peripheral wall 22. Each of the plurality of wheels 32 facilitates the suitcase 12 to be rolled along a support surface.

A plurality of hooks 48 is provided and each of the hooks 48 is coupled to the inner surface 24 corresponding to the second half 16. Thus, each of the hooks 48 may have an object suspended therefrom. The plurality of hooks 48 may be divided into a plurality of sets of hooks 50. Each of the sets of hooks 50 may be positioned at an associated one of four corners 52 of the suitcase 12. A pair of first fasteners 54 is provided and each of the first fasteners 54 is coupled to the inner surface 24 corresponding to the second half 16.

A bag 56 is provided and the bag 56 may contain an article of clothing 36. The bag 56 is removably coupled to the suitcase 12 such that the bag 56 is contained within the suitcase 12. The bag 56 has a front side 58, a back side 60 and a top edge 62 and an outer surface 64. A port 66 is coupled to the outer surface 26 and the port 66 is in fluid communication with an interior of the bag 56. The port 66 may be fluidly coupled to a vacuum or the like thereby facilitating air to be removed from the bag 56. The article of clothing 36 may comprise formal wear or the like. The bag 57 may be one of a plurality of bags 57 and each of the plurality of bags 57 may have a unique size with respect to each other.

The top edge 62 of the bag 56 has an opening 68 extending therethrough. The opening 68 may have a clothes hanger 70 extend outwardly therefrom when the article of clothing 36 is positioned within the bag 56. The bag 56 includes a pair of second fasteners 72 and each of the second fasteners 72 is coupled to the outer surface 64 corresponding to the back side 58. Each of the second fasteners 72 is positioned adjacent to the top edge 62. Each of the second fasteners 72 is complementary with respect to the first fasteners 54 such that the bag 56 is removably retained within the suitcase 12.

The bag 56 includes a plurality of loops 74. Each of the loops 74 is coupled to the bag 56 and each of the loops 74 may be suspended from a support. Each of the loops 74 is positioned on an associated one of four corners 76 of the bag 56. The front side 58 is split to access an interior of the bag 56. The bag 56 includes a coupler 78 that is attached to the front side 58 such that the coupler 78 selectively closes and opens the bag 56. The coupler 78 may comprise a zipper or the like.

A pair of shafts 80 is provided. Each of the shafts 80 removably engages the front side 58 of the bag 56 and each of the shafts 80 is positioned to extend laterally across the front side 58. The shafts 80 are spaced apart from each other such that the shafts 80 divide the bag 56 into a plurality of quadrants 82. The bag may be folded along each of the quadrants 82 such that the bag 56 fits within the suitcase 12. A plurality of connection points 84 are coupled to the outer surface 64 of the bag 56. The connection points 84 are arranged to form a pair of rows 86 and the rows 86 are spaced apart from each other. Each of the shafts 80 removably engages an associated row 86 of connection points 84.

In use, the article of clothing 36 is placed within the bag 56 and coupler 78 is manipulated to close the bag 56. The port 66 may be fluidly coupled to the bag 56 to remove the air from the bag 56. Each of the shafts 80 is positioned to removably engage the associated row 86 of connection points 84 and the bag 56 is folded along each of the shafts 80. The bag 56 is folded such that the second fasteners 72 are exposed. The bag 56 is positioned such that each of the second fasteners 72 engages an associated one of the first fasteners 54.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A clothing storage system comprising:

a suitcase comprising a first half being hingedly coupled to a second half such that said suitcase is positionable between an open position and a closed position;

a bag being configured to contain an article of clothing, said bag being configured to be fluidly coupled to a vacuum thereby facilitating air to be removed from said bag, said bag being removably coupled to said suitcase such that said bag is contained within said suitcase, said bag includes a plurality of loops, each of said loops being a respective line having opposite ends coupled to respective edges of said bag such that each of said loops extends outwardly from said respective edges of said bag to define an associated corner of four corners of said bag, said bag including a coupler being attached to said front side such that said coupler selectively closes and opens said bag; and a pair of shafts, each of said shafts removably engaging said bag, said shafts being spaced apart from each other such that said shafts divide said bag into a plurality of quadrants, said bag being configured to be folded along each of said quadrants such that said bag fits within said suitcase.

2. The system according to claim 1, wherein:

said suitcase has an inner surface; and a plurality of hooks, each of said hooks being coupled to said inner surface corresponding to said second half wherein each of said hooks is configured to have an object suspended therefrom.

3. The system according to claim 1, further comprising a pair of first fasteners, each of said first fasteners being coupled to said inner surface corresponding to said second half.

4. The system according to claim 1, wherein said bag has a front side, a back side and a top edge and an outer surface, said top edge having an opening extending therethrough wherein said opening is configured to have a clothes hanger extend outwardly therefrom when the article of clothing is positioned within said bag, said front side being split to access an interior of said bag.

5. The system according to claim 4, wherein:

said suitcase includes a pair of first fasteners; and said bag includes a pair of second fasteners, each of said second fasteners being coupled to said outer surface corresponding to said back side, each of said second fasteners being positioned adjacent to said top edge, each of said second fasteners being complementary with respect to said first couplers such that said bag is removably retained within said suitcase.

6. A clothing storage system comprising:

a suitcase comprising a first half being hingedly coupled to a second half such that said suitcase is positionable between an open position and a closed position, said suitcase having a peripheral wall and an inner surface;

a plurality of hooks, each of said hooks being coupled to said inner surface corresponding to said second half wherein each of said hooks is configured to have an object suspended therefrom;

a pair of first fasteners, each of said first fasteners being coupled to said inner surface corresponding to said second half;

a bag being configured to contain an article of clothing, said bag being configured to be fluidly coupled to a vacuum thereby facilitating air to be removed from said bag, said bag being removably coupled to said suitcase such that said bag is contained within said suitcase, said bag having a front side, a back side and a top edge and an outer surface, said top edge having an opening extending therethrough wherein said opening is configured to have a clothes hanger extend outwardly therefrom when the article of clothing is positioned within said bag, said front side being split to access an interior of said bag, said bag including a pair of second fasteners, each of said second fasteners being coupled to said outer surface corresponding to said back side, each of said second fasteners being positioned adjacent to said top edge, each of said second fasteners being complementary with respect to said first couplers such that said bag is removably retained within said suitcase, said bag including a plurality of loops, each of said loops being coupled to said bag wherein each of said loops is configured to be suspended from a support, each of said loops being positioned on an associated one of four corners of said bag, said bag including a coupler being attached to said front side such that said coupler selectively closes and opens said bag; and a pair of shafts, each of said shafts removably engaging said front side of said bag, each of said shafts being positioned to extend laterally across said front side, said shafts being spaced apart from each other such that said shafts divide said bag into a plurality of quadrants, said bag being configured to be folded along each of said quadrants such that said bag fits within said suitcase.

* * * * *